US008844169B1

(12) United States Patent
Savoie

(10) Patent No.: US 8,844,169 B1
(45) Date of Patent: Sep. 30, 2014

(54) CLEAT ATTACHMENT SYSTEM

(75) Inventor: Armand J. Savoie, Gardner, MA (US)

(73) Assignee: Cleats LLC, Marlborough, MA (US)

( * ) Notice: Subject to any disclaimer, the term of this patent is extended or adjusted under 35 U.S.C. 154(b) by 521 days.

(21) Appl. No.: 13/011,978

(22) Filed: Jan. 24, 2011

Related U.S. Application Data

(60) Provisional application No. 61/300,058, filed on Feb. 1, 2010.

(51) Int. Cl.
*A43B 5/00* (2006.01)
*A43C 15/02* (2006.01)

(52) U.S. Cl.
USPC ..... 36/67 R; 36/67 D; 36/134

(58) Field of Classification Search
USPC ..... 36/67 R, 67 D, 134
See application file for complete search history.

(56) References Cited

U.S. PATENT DOCUMENTS

| | | | | |
|---|---|---|---|---|
| 5,036,606 | A | 8/1991 | Erich et al. | 36/134 |
| 5,321,901 | A | 6/1994 | Kelly | 36/134 |
| 6,810,608 | B2 | 11/2004 | Kelly | 36/134 |
| 7,107,708 | B2 * | 9/2006 | Kelly et al. | 36/134 |
| RE40,460 | E | 8/2008 | Savoie | 36/134 |
| 7,891,118 | B2 * | 2/2011 | Chen et al. | 36/67 D |
| 8,006,409 | B2 * | 8/2011 | Chen et al. | 36/67 D |
| 8,201,348 | B2 * | 6/2012 | Kelly | 36/134 |
| 8,245,422 | B2 * | 8/2012 | Krikorian et al. | 36/134 |
| 2002/0152643 | A1 * | 10/2002 | Kim | 36/127 |
| 2004/0031171 | A1 * | 2/2004 | Chen | 36/134 |
| 2005/0000119 | A1 * | 1/2005 | McMullin | 36/134 |
| 2006/0005431 | A1 * | 1/2006 | Savoie | 36/134 |
| 2006/0059723 | A1 * | 3/2006 | Robinson et al. | 36/127 |
| 2006/0112598 | A1 * | 6/2006 | Savoie | 36/134 |
| 2008/0196276 | A1 * | 8/2008 | McMullin | 36/127 |
| 2009/0223088 | A1 * | 9/2009 | Krikorian et al. | 36/127 |
| 2009/0229147 | A1 * | 9/2009 | Mcmullin | 36/134 |
| 2010/0186262 | A1 * | 7/2010 | Krikorian et al. | 36/134 |

* cited by examiner

*Primary Examiner* — Marie Patterson
(74) *Attorney, Agent, or Firm* — Sunstein Kann Murphy & Timbers LLP

(57) ABSTRACT

A traction cleat attachment system for footwear that engages with a single click. The system comprises a cleat and a receptacle. The cleat includes a central stud with screw threads spaced about the outside surface of the stud. The receptacle includes a threaded annulus on a base for receiving the central stud of the cleat. The cleat also includes a collar coaxially surrounding the central stud with splines projecting from the interior collar surface. The threaded receptacle annulus is surrounded by two sets of alternating teeth projecting from the outside surface of the annulus. The height above the receptacle base of at least a portion of each tooth in the first set of teeth is less than the height of the second set of teeth above the base. The result is that cleat splines pass in turn over a corresponding tooth of less than full height and then a full tooth upon insertion and rotation. The cleat spline's interaction with the edge of a second tooth of less than full height in the receptacle impedes further rotation of cleat with respect to receptacle. The reduced height of the first tooth ensures that the user only experiences interference from the cleat's splines to a full height annulus tooth, providing a single click engagement system. Thus, the user obtains positive feedback that the cleat and socket have mated correctly.

7 Claims, 6 Drawing Sheets

CLEAT ATTACHMENT SYSTEM

This application claims priority from U.S. provisional patent application, Ser. No. 61/300,058, filed Feb. 1, 2010, entitled "Cleat Attachment System,", which is incorporated herein by reference.

TECHNICAL FIELD

This invention relates to the mounting of traction gear on the bottom of footwear, in particular, athletic footwear.

BACKGROUND

Progress has been made in recent years in reducing the labor involved in installing traction cleats into the outsoles of athletic shoes. For example, removable cleats employing the Q-LOK™ attachment structure, the TRI-LOK™ attachment structure, or the FASTTWIST™ attachment structure require less than a full turn to install the cleat into the mating receptacle. (Q-LOK™ is described in U.S. Pat. Nos. 5,768,809, 6,151,805, 6,108,944, and 6,463,681, while Fast Twist™ is described in U.S. Pat. Nos. 5,123,184, 5,524,367, 5,974,700 and 6,272,774, each of which patents is incorporated by reference herein in its entirety.) Because each athletic shoe usually includes many cleats, these attachment structures represented a step forward from previous systems that required multiple turns per cleat. However, some partial turn cleat systems can introduce some uncertainty as to whether the cleat has been turned sufficient degrees to firmly mate with the receptacle.

SUMMARY OF EMBODIMENTS OF THE INVENTION

In preferred embodiments of the present invention, a traction cleat attachment system for footwear is provided that engages with a single click. The system comprises a cleat and a receptacle. The cleat includes a central stud extending from a base on the footwear attachment side of the cleat, with a plurality of screw threads positioned around the outside surface of the stud. The central stud is surrounded by a plurality of cleat projections extending radially inward. The receptacle includes a threaded annulus on a base, with projections extending radially outward, away from the annulus. The threaded socket in the receptacle annulus is complementary to the threaded stud of the cleat—receptacle and cleat mate via insertion of stud into annulus socket and rotation. The cleat projections and receptacle projections interact to help prevent inadvertent detachment of the installed cleat from the receptacle. When the cleat stud is inserted into the receptacle annulus and rotated, cleat projections first experience increasing resistance to rotation from corresponding receptacle projections and then decreasing resistance to rotation from the same receptacle projection. Various means are provided to ensure cleat projections interact in this fashion with one (and only one) receptacle projection. This resistance profile, which a cleat installer may experience as a single "click," provides feedback to the installer that the cleat has been rotated enough (and no more than enough) to ensure proper engagement with the receptacle.

In some embodiments of the invention, the cleat projections are formed on the inner surface of a collar surrounding the central stud. The cleat projections deform when interacting with the receptacle projection and at least some of the projections may be partially hollow to facilitate deformation. In other embodiments of the invention, the cleat projections are flexible posts that extend from the cleat base which deflect when interacting with the receptacle projections.

In various embodiments of the invention, means to ensure that the cleat projections interact with a single receptacle projection according to the single click resistance profile can include one or more of:

providing two sets of alternating receptacle projections that differ in height above the receptacle base. During cleat installation into the receptacle, a cleat projection misses the first shorter receptacle projection, engages the next full height projection with a single click resistance profile, and is stopped by the front edge of the next receptacle projection, which is in the set of shorter projections. The top of the shorter projections can be shaped to facilitate single click action, such as slanting the projection's top. The angular disposition of cleat projections with respect to the central stud screw threads and angular disposition of receptacle projections with respect to annulus screw threads are selected so that cleat projections miss the first shorter projection upon installation;

selecting the depth of the receptacle annulus so that the end of the cleat central stud contacts the bottom surface of the annulus just after the cleat projection rotates past the receptacle projection producing the single click. Further rotation of cleat with respect to receptacle is thus prevented; and setting the height of one or more features of the cleat to contact one or more corresponding features of the receptacle just after the cleat projection rotates past the receptacle projection producing the single click. Further rotation of the cleat with respect to the receptacle is thus impeded.

BRIEF DESCRIPTION OF THE DRAWINGS

The foregoing features of the invention will be more readily understood by reference to the following detailed description, taken with reference to the accompanying drawings, in which:

FIG. 4A is a top down view of the footwear attachment face of the cleat of FIG. 1 showing positioning of the cleat threads with respect to the collar splines for the embodiment of FIG. 1, while

DETAILED DESCRIPTION OF SPECIFIC EMBODIMENTS

Definitions. As used in this description and the accompanying claims, the following terms shall have the meanings indicated, unless the context otherwise requires:

"Footwear" means any outer covering for a foot including, without limitation, athletic footwear, sandals, boots, shoes and slippers.

In preferred embodiments of the present invention, a traction cleat attachment system for footwear is provided that engages with a single click. The system comprises a cleat and a receptacle. The cleat includes a central stud extending from a base on the footwear attachment side of the cleat, with a plurality of screw threads positioned around the outside surface of the stud. The central stud is surrounded by a collar with a plurality of splines projecting radially inward from the inner surface of the collar. The receptacle includes a threaded annulus on a base, with teeth projecting radially outward, from the outer surface of the annulus. The threaded socket in the annulus is complementary to the threaded central stud of the cleat—receptacle and cleat mate via insertion of stud into annulus socket and rotation. The cleat splines and receptacle teeth interact to prevent inadvertent detachment of the installed cleat from the receptacle. When the cleat stud is inserted into the receptacle annulus and rotated, cleat splines first experience increasing resistance to rotation from the corresponding receptacle teeth and then decreasing resistance to rotation from the same receptacle teeth. Various means are provided to facilitate cleat spline interaction with one (and only one) receptacle tooth with this resistance profile which will be called in this description and any appended claims, "a single click." This resistance profile can provide feedback to the installer that the cleat has been rotated enough (and no more than enough) to ensure proper engagement with the receptacle. In some embodiments, this resistance profile produces a single, audible click when the cleat is properly installed into the receptacle.

Figure 1:
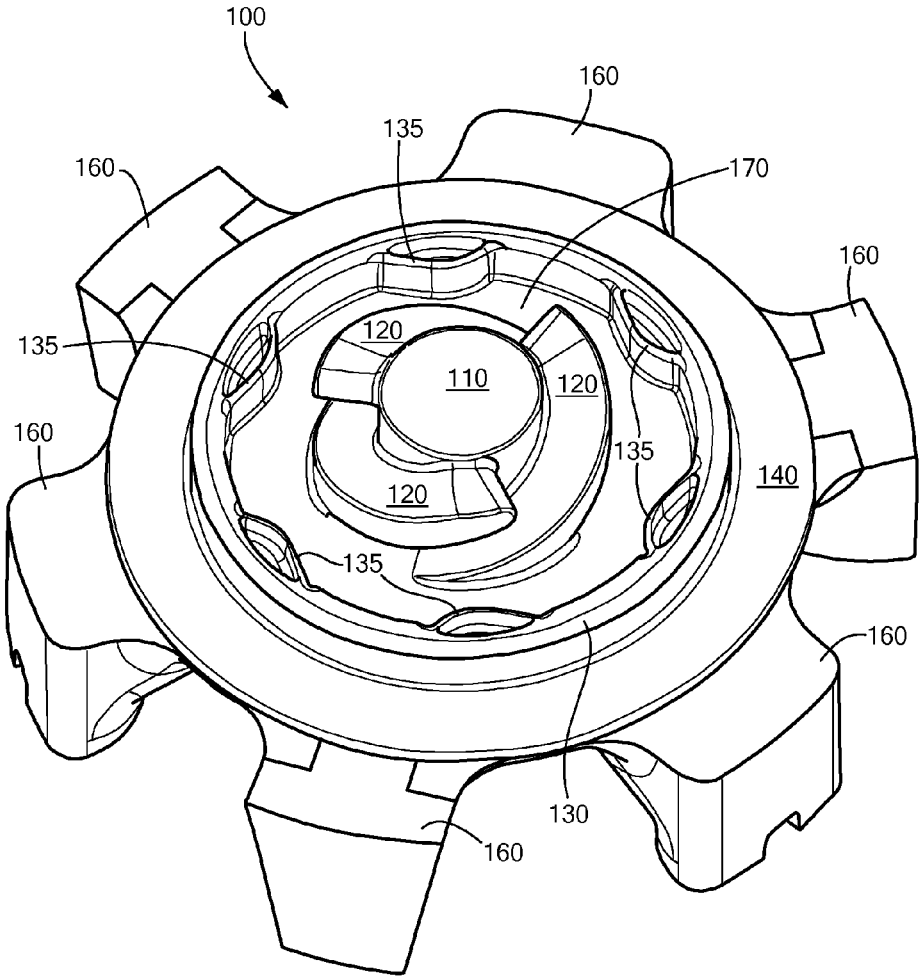
FIG. 1 is a perspective view of the attachment side of a removable cleat for footwear, according to an embodiment of the invention.

In a preferred embodiment of the invention, a traction cleat 100 for footwear is provided as shown in FIG. 1. FIG. 1 shows the face of the cleat 100 that includes a mechanism to removably attach the cleat to a mating receptacle (described below) with a single click. The cleat is attached to the receptacle by insertion of the cleat attachment mechanism into the mating structure on the receptacle (as described below) and rotation. A plurality of mating receptacles is typically installed in the outsole of footwear to receive a corresponding plurality of cleats. The other face of the cleat includes traction projections to provide friction with a ground surface, when the cleat engages the ground.

Cleat 100 includes a base 140. The base 140 supports the cleat's attachment mechanism on one face and one or more traction projections 160 on the other face. The attachment mechanism includes a threaded central stud 110 and a collar 130, forming an annular well 170 between stud and collar. The central stud projects from the base 140 and has an axis which is perpendicular to the base. Three screw threads 120 are spaced around and on the outer peripheral surface of the central stud 110. The cleat is installed into the receptacle by insertion of the central stud into the mating structure on the receptacle (described below) and rotation of the cleat about the axis of the central stud. The collar 130 is provided with a plurality of radial splines 135 disposed on the collar surface which faces the central stud. The number and disposition of the splines 135 around the inner surface of the collar 130 is chosen, in various embodiments, to cooperate with the teeth of the mating receptacle to help ensure that the cleat and receptacle do not inadvertently rotate with respect to each other during ground contact of the cleat. In some embodiments of the invention, at least some of the splines 135 are at least partially hollow to allow the splines to more easily deform when engaging the teeth of the receptacle. In this embodiment of the invention, the cleat attachment mechanism allows the cleat to be coupled with and locked to the mating receptacle with a rotation of the cleat about the central stud axis of less than seventy degrees.

In one embodiment of the invention, the splines 135 of the cleat collar extend less than 2 millimeters from the adjacent surface of the base of the cleat, at the annular well 170. In another embodiment of the invention, the end of the central stud 110 extends less than 2.5 millimeters beyond the distance the splines 135 extend from the adjacent surface of the base of the cleat 170. In a further embodiment of the invention, the end of the central stud extends less than 4 millimeters from the adjacent surface of the base 170. In various embodiments of the invention, each cleat screw thread 120 extends between fifty degrees and one hundred and fifty degrees around the axis of the central stud 110.

Figure 2:
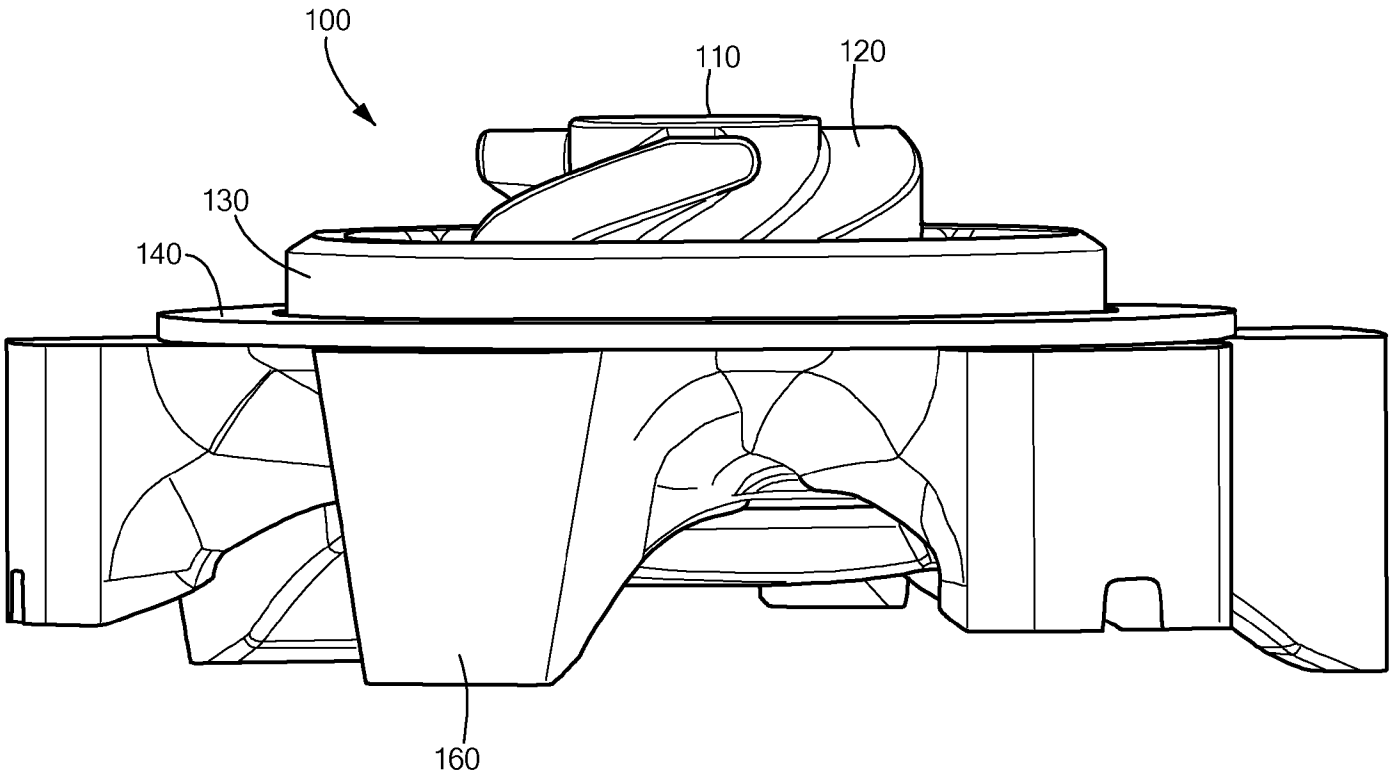
FIG. 2 is a side view of the cleat of FIG. 1.

FIG. 2 shows the cleat 100 of FIG. 1 in a side view. The ground engaging face of the cleat is provided with traction projections 160 to cause friction with the ground when the cleat engages the ground.

Figure 3:
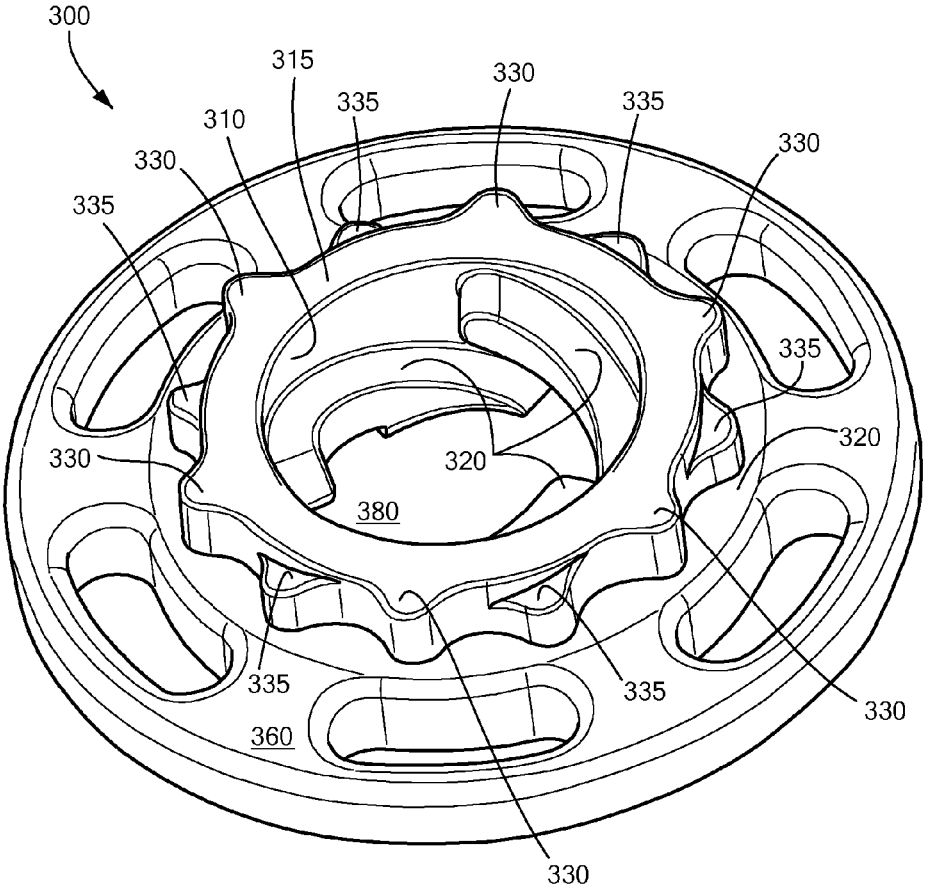
FIG. 3 is a perspective view of the attachment side of a receptacle that mates with the cleat of FIG. 1, in an embodiment of the invention.
Figure 4A:
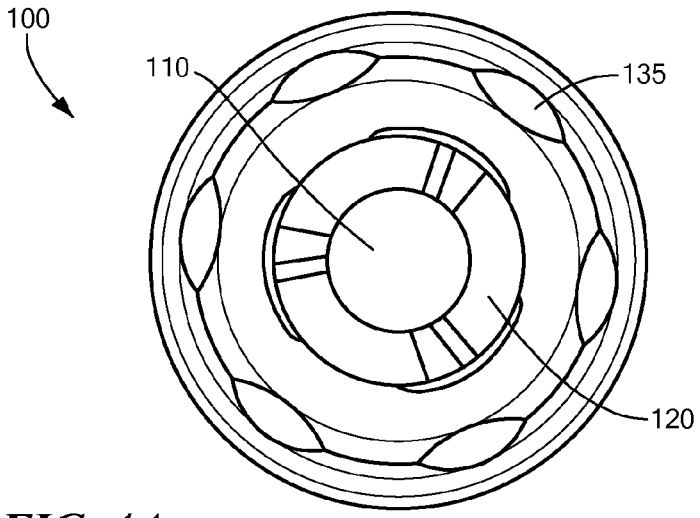
Figure 4B:
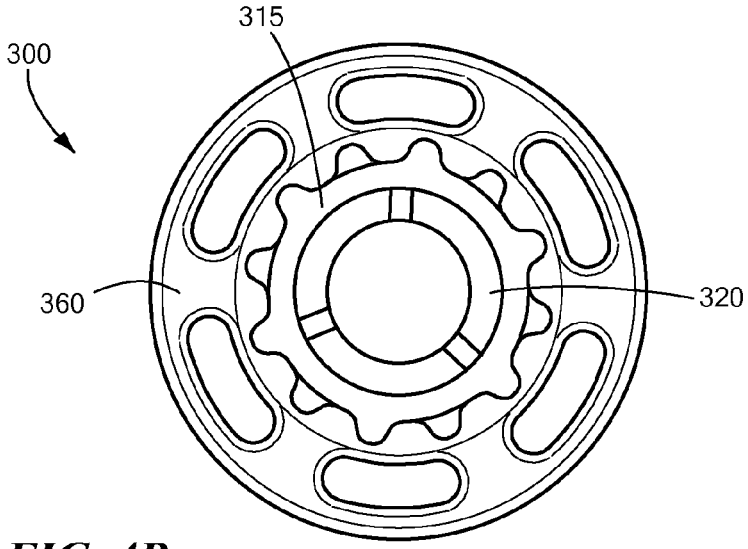
FIG. 4B is the corresponding view for the receptacle of FIG. 3.
Figure 6:
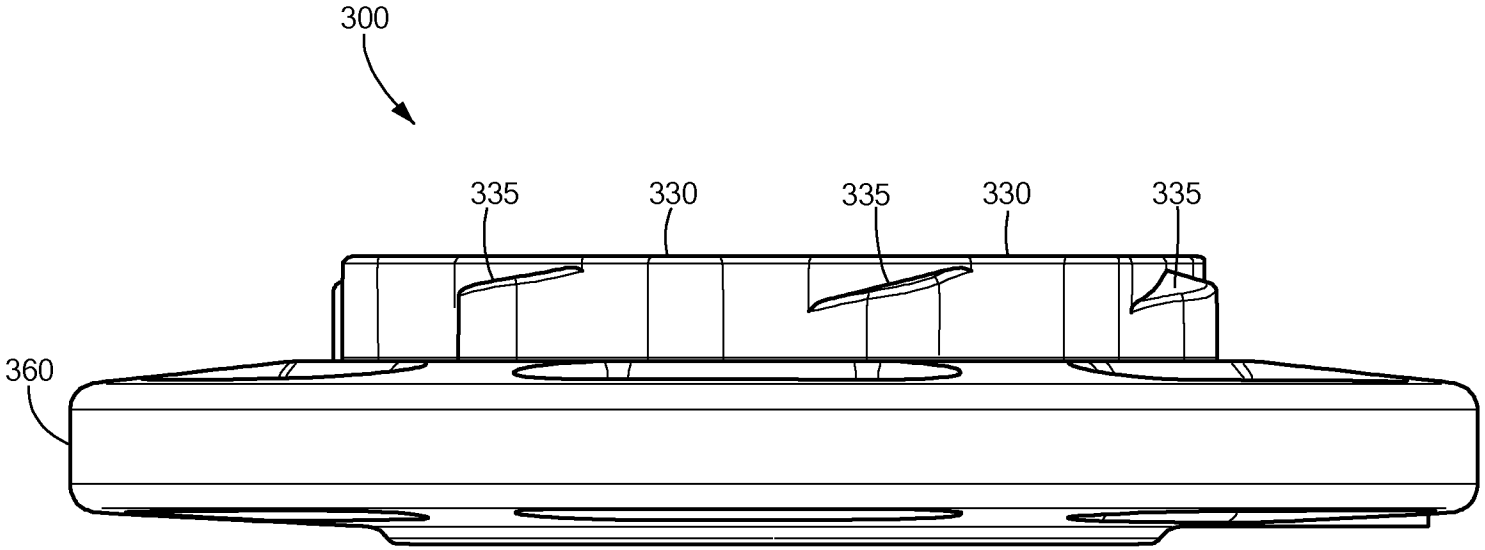
FIG. 6 is a side view of the receptacle of FIG. 3.

FIG. 3 shows a mating receptacle 300 for the cleat 100 of FIG. 1, according to an embodiment of the invention. The receptacle includes a base 340 with a flange 360 that extends to the periphery of the receptacle. The flange 360 retains the receptacle in the outsole of footwear, after over molding or another similar process. The receptacle has a threaded annulus 310 that removably mates with the central stud 110 of the cleat 100. The receptacle annulus 310 has a top 315 and a central axis that is generally perpendicular to the base 340 of the receptacle. The central stud 110 of the cleat is inserted into the threaded annulus 310 and the screw threads 320 of the receptacle mate with the corresponding threads 120 of the cleat stud 110, as the cleat is rotated about its axis. The receptacle annulus 310 includes two sets of radial teeth 330, 335 extending outwardly from the annulus's outer surface. The height for a receptacle tooth or a receptacle projection in this specification and in any appended claims will be the average distance from the base of the end of the tooth distal from the base. The teeth in the first set 330 have a first height. The teeth in the second set 335 have a second height above the base, where the second height is less than the first height. When the cleat stud is inserted into the threaded annulus and rotated, cleat splines rotate past a shorter tooth projection 335 without interference and then interact with a full height tooth 330. The splines first meet increasing resistance from the full height teeth 330 causing the splines to deform and then decreasing resistance as the splines revert, at least partially, to their former shape. (This resistance profile produces a single click.) One or more features of the cleat and receptacle combine to prevent a cleat spline from interacting with the next receptacle tooth in the rotation to produce a second click. These features include:

A. Height and profile of the receptacle teeth. As shown in FIG. 3, the end of the tooth distal to the base 340 in the second set 335 is shorter (in part) than its adjacent tooth, which is in the first set 330. When the cleat is first inserted into the receptacle and rotated, the shorter tooth allows a spline to pass by without interference. As the cleat rotates further, the spline next interacts with a full height tooth in the first set 330 to produce a click. With further rotation, the spline next encounters a partial height tooth 335. Note that the multi-start screw threads provided for cleat stud and receptacle annulus facilitate rapid advancement of the stud into the receptacle annulus, as the cleat rotates. This rapid advancement of the stud into the receptacle annulus increases the surface area of the spline presented to the front surface of the next (short) tooth in the rotation, after the single click—the spline has advanced much of the distance to the receptacle base 340. The height and profile of the shorter teeth are set to substantially impede the spline when the stud has advanced into the receptacle annulus. In some embodiments, the ends of the teeth in the second set 335 are slanted, as shown in FIGS. 3 and 6. This profile allows the splines to initially pass by the teeth 335 without interference, and then experience a high level of interference to rotation when the spline again meets a shorter tooth 335, after it has produced a single click. The angular disposition of cleat splines with respect to the central stud screw threads and angular disposition of receptacle teeth with respect to annulus screw threads are selected so that splines miss the first shorter tooth the spline encounters upon installation. The relationship between the angular placement of splines and central stud screw threads for the cleat 100 is shown in FIG. 4A. FIG. 4B shows the corresponding relationship for the screw threads and tooth projections of the mating receptacle 300 to provide a suitable engagement of cleat with receptacle.

Figure 5:
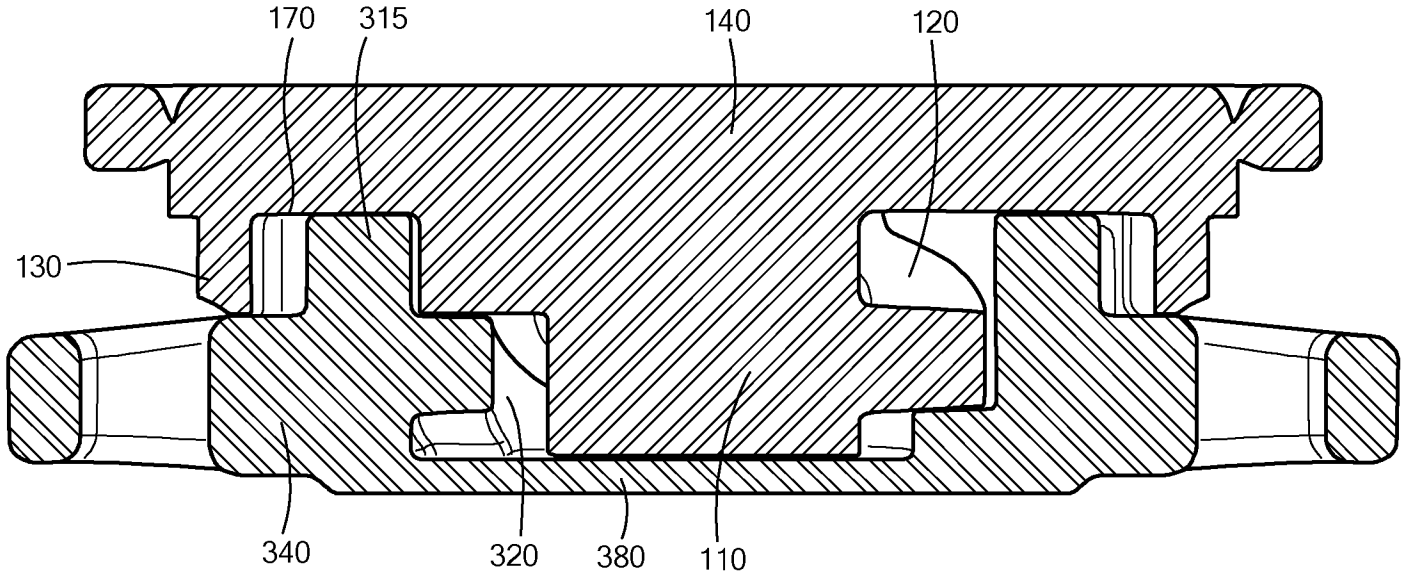
FIG. 5 shows a cutaway, side view of the cleat of FIG. 1 installed into the receptacle of FIG. 3.

B. The depth of the receptacle annulus and the length of the cleat stud. These elements can be dimensioned so that the end of the cleat central stud 110 contacts the bottom surface of the annulus 380 just after the cleat projection rotates past the receptacle projection producing the single click. Further rotation of cleat with respect to receptacle is thus prevented. This arrangement is illustrated in FIG. 5, which is a cutaway side view of the cleat 100 of FIG. 1 mated with the receptacle 300 of FIG. 3.

C. Setting the height of one or more features of the cleat to contact one or more corresponding features of the receptacle just after the cleat projection rotates past the receptacle projection producing the single click. For example, as shown in FIG. 5, the top of the receptacle annulus 315 can contact the annular well 170 of the cleat or the cleat collar 130 may contact a portion of the receptacle base. Further rotation of the cleat with respect to the receptacle is thus prevented.

The features identified are provided for illustration and not by way of limitation. The features may be mixed in any combination that substantially impedes the cleat splines from rotating past the next tooth after the spline generates a first click. Other features that impede rotation of the cleat when the splines meet the second short tooth in the rotation can be employed in other embodiments of the invention FIG. 5 shows the receptacle 300 of FIG. 3 in side view. Full height teeth projections 330 alternate with teeth 335, whose height is less than full height for at least a portion of the tooth. The flange 360 of the base 340 of the receptacle is also shown. In an embodiment of the invention, the receptacle has a total height of less than 5 millimeters.

In another embodiment of the invention, the cleat collar 130 with splines 135 described above is replaced by a ring of deflectable posts that surrounds the cleat's central stud. The posts deflect outward from the central stud under pressure from the receptacle projections, as the cleat is installed into the receptacle. As a post rotates past a full height receptacle projection, the post springs inward to provide a single click. One or more of the features described above are employed to prevent the posts from interacting with the next receptacle projection to produce a second click.

In various embodiments of the invention, system components can be made of any of a variety of materials, including plastic and metal. The components may be fabricated by processes typical for such components such as injection molding, die cut and assembly (adhered, glued, etc.), compression and flow molding, casting, etc.

Similarly, it is of course apparent that the present invention is not limited to the detailed description set forth above. Various changes and modifications of this invention as described will be apparent to those skilled in the art without departing from the spirit and scope of this invention as defined in the appended claims. For example, while embodiments of the invention with three screw threads on the cleat and on the receptacle have been described above, the number of screw threads in other embodiments may vary. The number of cleat projections and receptacle projections can vary and, in some embodiments, the set of shorter teeth may be partially or fully eliminated. In such an embodiment, other features of the cleat and receptacle prevent further clicks after the first.

I claim:

1. An attachment mechanism for a removable cleat, the attachment mechanism comprising:

a base;

a central stud projecting from the base and disposed about a central axis, about which the attachment mechanism may be rotated for insertion into a receptacle, the central stud having an end distal from the base and having an outer peripheral surface;

a plurality of screw threads spaced around and on the outer peripheral surface of the central stud, each screw thread having an outer helical surface;

a plurality of locking projections disposed around the screw threads such that the locking projections are radially spaced outside of the outer helical surfaces of the screw threads, wherein each of the locking projections extends less than 2 mm from the base and some of the projections are at least partially hollow;

a cylindrical cuff disposed concentrically around the central stud, the cylindrical cuff having inner and outer surfaces, wherein the locking projections are attached to the inner surface of the cylindrical cuff, and wherein an annular gap is defined between the outer helical surfaces of the screw threads and the inner surface of the cylindrical cuff; and wherein the attachment mechanism permits a cleat to be connected to and locked to a receptacle with a turn of less than 70° around the central axis.

2. The attachment mechanism of claim 1, wherein the distal end of the stud is less than 4 mm from the base.

3. The attachment mechanism of claim 1, wherein the distal end of the stud extends less than 2.5 mm beyond the distance that each locking projections extends from the surface of the base adjacent to the locking projection.

4. The attachment mechanism of claim 1, wherein each screw thread extends between 50° and 150° around the central axis.

5. The attachment mechanism for a removable cleat, the attachment mechanism comprising:

a base;

a central stud projecting from the base and disposed about a central axis, about which the attachment mechanism may be rotated for insertion into a receptacle, the central stud having an end distal from the base and having an outer peripheral surface;

a plurality of screw threads spaced around and on the outer peripheral surface of the central stud, each screw thread having an outer helical surface;

a plurality of resiliently deflectable locking projections attached to collar surrounding the stud and projecting inwardly; and wherein the attachment mechanism permits a cleat to be connected to and locked to a receptacle with a turn of less than 70° around the central axis, wherein the distal end of the stud is less than 4 mm from the base.

6. A receptacle adapted to be molded into the outsole of an athletic shoe and to receive an attachment mechanism for a removable cleat, the receptacle comprising:

a base;

an annulus having inner and outer surfaces, the inner surface having defined thereon a plurality of equally spaced helical surfaces adapted to receive screw threads on the attachment mechanism;

a first set of radial projections extending outwardly from the annulus's outer surface, the first set of radial projections having a first height above the base and a second set of radial projections extending outwardly from the annulus's outer surface, the height above the base of the projections in the second set less than the first height; and means for preventing the attachment mechanism for the removable cleat from producing more than a single click when screwed into the receptacle, wherein the attachment mechanism has locking projections.

7. The receptacle according to claim 6, wherein the receptacle has a height of less than 5 mm.

* * * * *